United States Patent [19]

Crowther

[11] Patent Number: 4,652,034

[45] Date of Patent: Mar. 24, 1987

[54] MULTIPLE BOOK STORAGE AND CARRYING CASE

[75] Inventor: Duane S. Crowther, Bountiful, Utah

[73] Assignee: Horizon Publishers & Distributors, Inc., Bountiful, Utah

[21] Appl. No.: 836,560

[22] Filed: Mar. 6, 1986

[51] Int. Cl.[4] ..... B65D 77/00

[52] U.S. Cl. ..... 294/138

[58] Field of Search ..... 294/138; 150/52 R; 206/424; 281/19 R, 19 A, 20, 21 R, 29, 31, 34, 35, 42; 283/64

[56] References Cited

U.S. PATENT DOCUMENTS 206,216 7/1878 Berth ..... 294/138

665,256 1/1901 McComb ..... 294/138

*Primary Examiner*—James B. Marbert

[57] ABSTRACT

The invention is an improved multiple book storage and carrying case. It comprises a case with spine and hingedly attached front and back bindings with page covers, having a center flap divider attached to the inside of the spine. The page cover ends have pockets covering them into which the covers of books to be held are inserted. The page cover flaps attached to edges of the front and back bindings have openable closure means associated with the edges of the page cover flaps to either selectively seal together the flaps for storage, or open said flaps to access the books stored within the case.

16 Claims, 6 Drawing Figures

MULTIPLE BOOK STORAGE AND CARRYING CASE

FIELD

This invention relates to book carrying and storage cases. More particularly, it relates to book carrying cases which hold at least two books.

STATE OF THE ART

A number of book carrying cases are known. Applicant previously designed a book carrying case adapted for carrying two books separated by a center flap divider. The case had a spine with a width the thickness or the two books. Attached to the edges of the spine were similarly sized front and back bindings sized to cover the book covers. The front and back bindings were at least the size of the larger book cover, if books to be carried differed in size. Attached to the edges of the front and back bindings were page cover flaps. The bindings and page cover flaps encased the book when the flaps were openably sealed together with closure means, such as a zipper associated therewith. The spine had a handle attached to its exterior to aid the user in carrying the books when held within the base.

Applicant's previous models were not designed for carrying more than two volumes. The page cover flaps also prevented the center flap divider from lying flat against the bindings to enable the book to open flat when the case was opened. As the primary purpose for applicant's case was to enable either volume to be accessed and held flat for reading when standing or sitting, it was essential that the center flap divider hold the volumes flat when opened. These previous models also had attached to the bindings external vertical pockets alligned normal the axial length of the spine. These normally alligned pockets allowed items placed therein to fall out occasionally when the case was carried by the handle. Applicant's improved multiple book case eliminates these problems.

SUMMARY OF THE INVENTION

Applicant's invention provides an improved multiple book storage and carrying case. It comprises: a spine at least the length of the books to be stored, and a width at least the thickness of the books to be stored. Similarly sized front and back bindings are hingedly attached to the edges of the spine. The bindings are sized to cover the book covers to be carried within the case. Page cover flaps are attached to the edges of the front and back bindings to cover the pages of the books stored in the case. Closure means, such as a zipper, are attached to the edges of the page cover flaps to selectively open or seal together the edges of said page cover flaps. At least one center flap divider for every pair of books to be carried is attached to the spine to separate and hold the books to be stored within the case. The center flap divider is sized the width and length of the larger of the pair of book covers to be held, and has an approximately 60° angle cut proximate the point of attachment to the spine to prevent the flap from contacting the page covers when the case is opened, and draws in the page covers to fold against the interior of the bindings near the spine. Vertically alligned pockets are attached to cover the ends of both sides of the center flap divider opposite the spine. The pockets are structured to carry books by their covers when inserted within the pockets on either side of the flap. Where more than two center flap dividers are included, the dividers are attached to the spine and separated from one another by a distance of at least the thickness of the two books to be stored side by side. The pocket openings parallel the longitudinal axis of the spine and are structured to accommodate and secure therein the covers of the books to position and hold the book spines next to the spine of the case. A carrying handle may be attached to the outside of the spine.

In one preferred embodiment, external storage pockets are attached to the exterior of the front and back bindings having openings longitudinally alligned with the longitudinal axis of the spine. This storage pocket opening allignment prevents articles placed in the pockets from falling out when the case is carried by the handle. The pocket opening is approximately 1½ inches from the spine. These exterior storage pockets may include a zipper closure to secure articles placed therein.

The case is constructed of a flexible material made of cloth backed vinyl plastic, nylon, pack cloth, canvas, quilted fabric, or a similar type of material. The case book binding exteriors may be colored or patterned to suit the preference of a user.

The handle is also generally constructed of a material similar to that used to make the case. The handle piece is rolled and sewn flat. The handle ends are then sewn to the spine. A strip of fabric webbing or a nylon ribbon may be sewn inside the handle for inside reinforcement. The handle is attached to the spine by sewing the ends of the handle to the spine. Preferably, the handle is attached in a rectangular stitched pattern leaving at least ⅛ inch of vinyl on either side of the handle seam to help prevent tearing. The space between the seams and the edges of the sewn piece reduces stress placed on the material at the point of attachment of the piece. In another embodiment, tear stress is reduced by constructing the handle of nylon webbing, cut to length and sewn to the spine or attached to metal rings which are sewn to the spine.

The spine, front and back bindings, center flap divider, page cover flaps, and closure means are usually attached by sewing the parts together. At the end of all stitching, backstitching is done to keep the sewing from breaking. Backstitching, where sewing ends, was increased to two extra passes to prevent the thread from coming undone. The depth of the center flap divider pockets is approximately 3 inches to facilitate insertion of the book covers. The previous 4 inch center flap divider was changed to 3 inches to prevent bending of the book covers upon insertion or removal.

The segment proximate the point of attachment of the center flap divider to the spine was angled to about 60° to prevent the center flap divider from contacting the folds of the zipper closure means against the book bindings when the case is opened. Structured in this manner, the center flap divider is not prevented from lying flat against the bindings to hold the volume open.

The inside corner seams of the case bindings are preferably rounded and trimmed rather than cut diagonally. This facilitates closing and unclosing of the case by minimizing the turn stress placed on the closure means. The corners of the center flap divider are also correspondingly smoothly rounded, making a 90° angle in one inch, to fit within the case. Additional layers of vinyl are added to the spine to prevent stitches from pulling through at stress points. These additional layers also stiffen the spine and give a finished appearance to the inside of the spine.

An inside pencil pocket or loop may be attached to the inside of the case. This pencil pocket is made of a piece of ⅝ inch wide elastic stitched to the inside of the case cover. Other interior pockets attached to the interior of the bindings may also be included for additional storage.

The case is constructed of different patterned and colored materials to suit the preference of a user. In one preferred embodiment, a trumpeting angel cut out of the exterior case binding has been included to expose an underlying contrasting material through the cut out. Other design cut outs include crosses, doves, butterflies, swords, a fish with a cross superimposed, etc. In another embodiment, a plaid material is used to construct the exterior case binding, and the case is closed with hook and loop strip closure means.

Larger external auxiliary notions pockets attached to the exterior of the bindings may be included to carry a user's keys, wallet, checkbook, and other personal items. These eliminate the need for a user's purse or other small item carryall.

Applicant's improved book case thus enables either book to be readily accessed and held flat for reading. The books can be easily inserted or removed as the user's reading requirements change. The improved case center flap divider design eliminates severe bending of the book covers when the books are inserted or removed. The cases can be used to hold scriptural materials, hymnals, educational materials, and other volumes required to be sequentially read and held flat while reading in a sitting or standing position without the aid of a lecturn or podium.

DESCRIPTION OF THE ILLUSTRATED EMBODIMENTS

Figure 1:
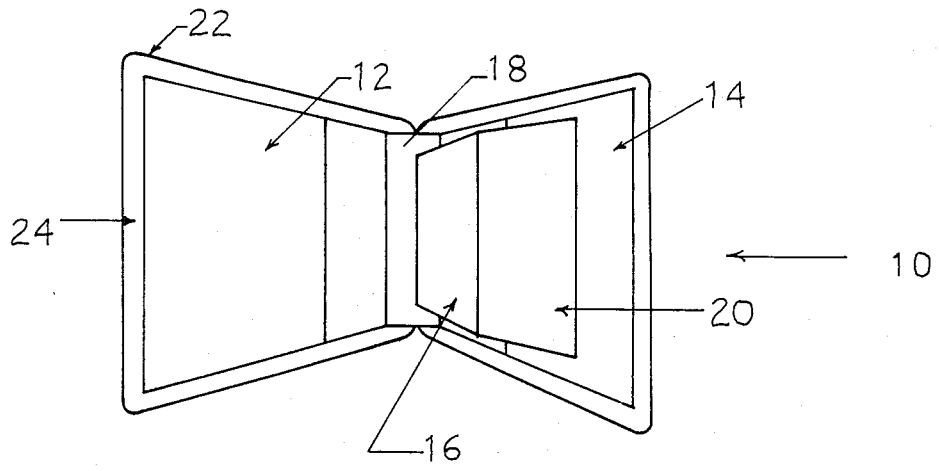
FIG. 1 illustrates a book case produced by applicant.

FIG. 1 illustrates one embodiment of applicant's old case 10, having bindings 12, 14 and a center flap divider 16, attached to the spine 18. The bindings 12,14, were hingedly attached by their edges to the edges of spine 18, such that said bindings 12, 14 would open and close books stored in the case 10. The overall dimensions of case 10 bindings 12,14 were usually constructed approximately 8 9/16 inches by 6 6/16 inches; or approximately 10 11/16 inches by 7 11/16 inches to cover the book covers of the volumes stored within the case 10. The old case 10 included a single center flap divider 16 attached to the spine 18 of the case 10. The spine 18 width corresponded to the thickness of the books (not shown) to be carried within the case 10. The spine 18 length was slightly larger than the length of the spine of the books to be carried.

The center flap divider 16 was attached to the spine 16 to sandwich the center flap divider 16 between the books stored in the case 10 to prevent bending of the center flap divider 16. Pockets 20 covering the ends of the center flap divider 16 were attached to the center flap divider 16. The covers of the books to be stored were inserted in the pockets 20. The pockets 20 were approximately 4 inches in depth, which required the bookcovers to be severely bent when inserted. The divider 16 and the books inserted therein were prevented fron lying flat against the bindings 12,14 by the page cover flaps 22. The bindings 12,14 were cut with square corners, which prevented the zipper closure 24 from smoothly closing when rounding the case 10 corners. The front and back bindings 12, 14 were hingedly attached to the spine 18 to enwrap about the books stored in the case 10. Page cover flaps 22 were attached at right angles to the perimeter edges of the covers 12, 14 to cover the pages of the books stored in the case 10. These page cover flaps 22, when the case 10 is opened, are drawn in towards the bindings 12, 14 proximate the spine 18.

As shown in FIG. 1, the drawn in flaps 22 prevented the center flap divider 16 from folding flat against the interior of the bindings 12,14 to enable the user to selectively open either book for use. A zipper closure 24 attached to the edges of the page covers 22 secured the page covers 22 together to close the books within the case 10.

Figure 2:
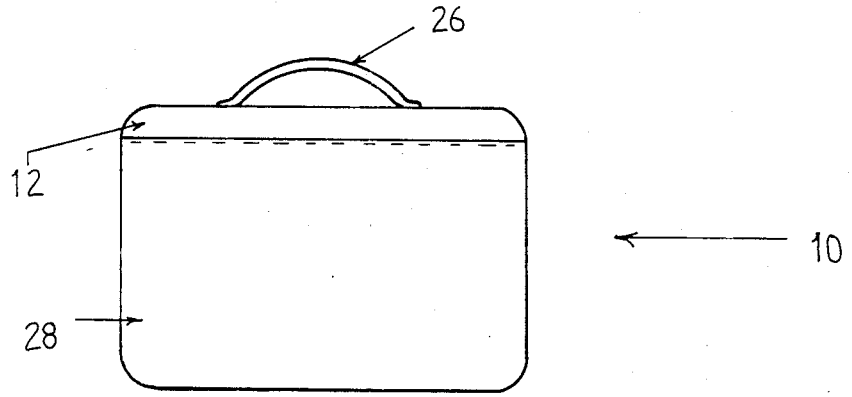
FIG. 2 is a side of applicant's invention.

FIG. 2 shows the exterior of applicant's improved case 10. A handle 26 is attached to the exterior spine 18 to assist in carrying the case 10. An exterior auxilliary notions pocket 28 is attached to the exterior of the binding 12 for carrying articles. A zipper closure (not shown) may be included to close the pocket opening (not shown) to secure articles placed in the pocket 28. The pocket opening (not shown) is longitudinally alligned with the spine 18 to prevent articles placed in the pocket 28 from falling out, when the case 10 is carried by the handle 26.

Figure 3:
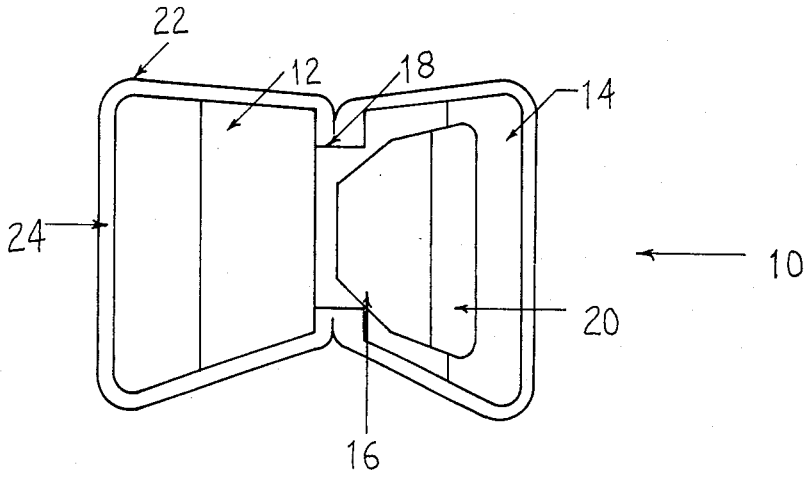
FIG. 3 is a perspective view of applicant's invention.

FIG. 3 illustrates the interior of applicant's improved design of the case 10. The length of the spine 18 is slightly shorter than the books to be stored in the case so that the page cover flaps 22 extend around and cover a portion of the back of the spine of the books. This cover flap 22 extension, when opened, creates a wider opening to allow the book bindings 12,14 to open and lie flat without being restricted by the cover flaps 22.

The center flap divider 16 is joined to the spine 18 at an approximately 60° angle to enable the center flap divider 16 to clear the page cover flaps 22 drawn in by the front and back bindings 12,14, as the case is opened. Pockets 20 are attached to cover the ends of both sides of the center flap divider 16. They are structured three inches deep to secure about and hold the ends of the book covers inserted therein. The corners of the case 10 are rounded to assist in closing the case 10. The case 10 is constructed of vinyl covered cloth in a variety of colors and patterns adorning the exterior of the covers 12, 14. Preferably, the case 10 is constructed of a water resistent material to protect the books stored therein from the weather. Other flexible cloth materials may be used.

Figure 4:
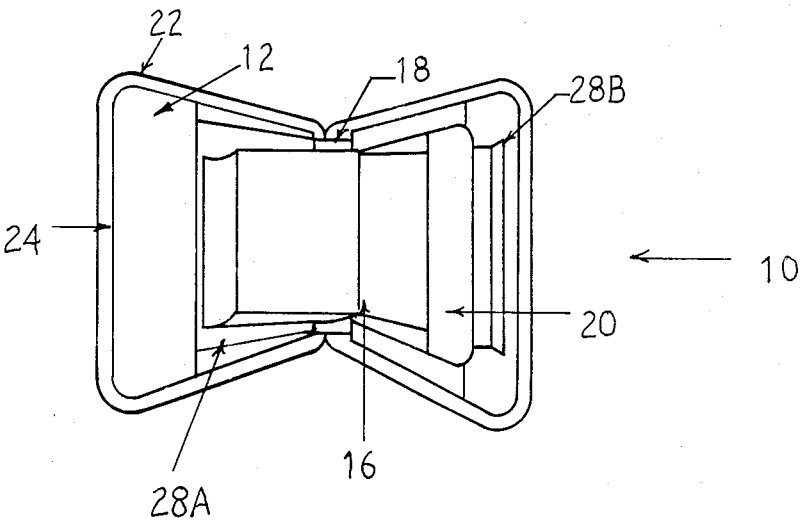
FIG. 4 is another perspective view of applicant's invention.

FIG. 4 illustrates applicant's case 10 carrying two books, 28A, 28B. The books 28A and 28B are secured by inserting their covers into the pockets 20 on both sides of the single center flap divider 16.

Figure 5:
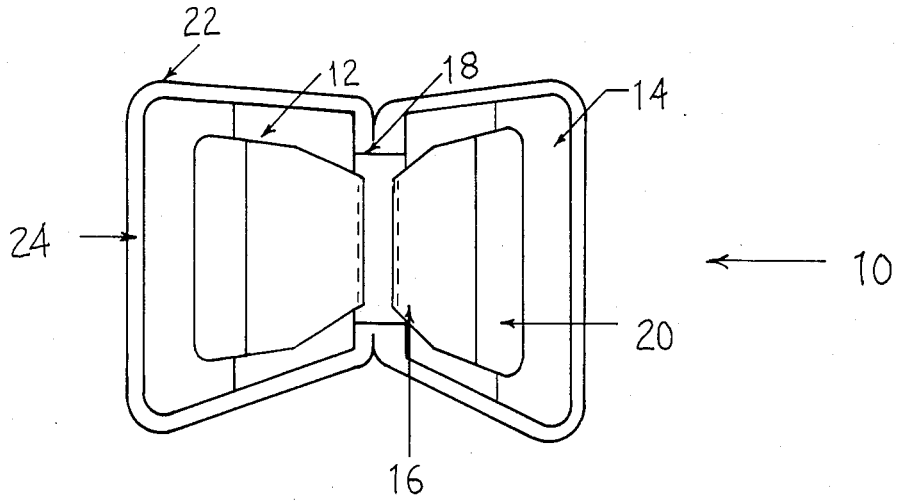
FIG. 5 is perspective view of another embodiment of applicant's invention.

FIG. 5 illustrates an embodiment of applicant's case 10, with two center flap dividers 16. This particular embodiment can carry up to four volumes.

Figure 6:
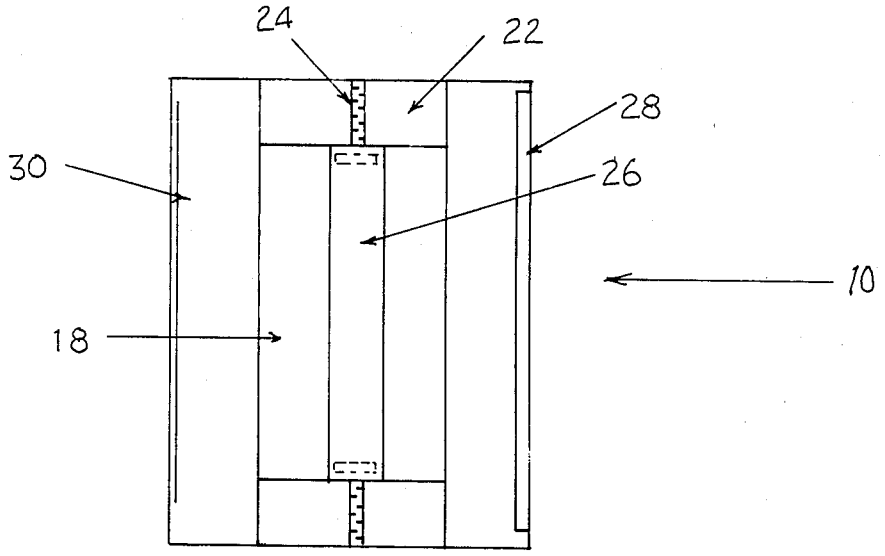
FIG. 6 is a top view of applicant's invention.

FIG. 6 illustrates a top view of applicant's case 10 showing the position of attachment of the rolled handle 26 to the exterior of the spine 18. The rolled handle 26 not only provides a stronger construction, but also gives a better appearance to the handle 26. The handle 26 is sewn to the spine 18 with two rows of stitches which leave approximately an eighth of an inch space between the edge of the handle 26 and the end of the stitches. This space prevents the handle from tearing at the end of the stitches. Also shown is the top view of the exterior auxilliary notions pocket 30, the exterior pocket 28, and the extent the page cover flaps 22 extend to cover the back of the books to be stored within the case 10.

The case 10 bindings 12, 14, and cover flaps 22 may be joined with a welting (not shown) to add an attractive finish to the case 10. The inside fabric where the bindings 12,14 and cover flaps 22 are sewn together and trimmed at the corners of the case 10 to provide a squarer corner.

Although this specification has made reference to the specific embodiments, it is not intended to restrict the scope of the appended claims. The claims themselves contain those restrictions deemed essential to the invention.

I claim:

1. An improved multiple book storage and carrying case comprising:

a. a case with spine at least the width of the thickness of the books to be stored within the case, and hingedly attached front and back bindings with page cover flaps, attached to the spine to enwrap about the books stored within the case;

b. at least one center flap divider attached to the inside of the spine having pockets covering the ends of the divider into which the covers of books are inserted and held, said dividers sized to extend the width and cover the length and edge of the books to be stored, and having their upper and lower edges angled proximate the point of attachment to the spine to enable the page cover flaps to clear the divider as said flaps are drawn in against the interior of the bindings as the case is opened; and c. openable closure means associated with the edges of the page cover flaps to either selectively seal together said flaps to store the books inside the case, or separate said flaps to access the books stored within the case.

2. An improved multivolume book storage and carrying case according to claim 1, wherein the closure means comprises a zipper fastening system.

3. An improved multivolume book storage and carrying case according to claim 1, wherein the closure means comprises corresponding hook and loop strips.

4. An improved multivolume book storage and carrying case according to claim 1, wherein the center flap divider is removably attached to the inside of the spine.

5. An improved multivolume book storage and carrying case comprising:

a. A spine having a width approximately the thickness of the stacked books to be carried within the case, and a length slightly shorter than the length of the longest book to be carried in the case;

b. Front and rear case bindings hingedly attached by their edges to the spine and structured to, in the open mode, lie flat to enable access to the books contained within the case, and, in the closed mode, seal said bindings about the covers of the books for storage within the case;

c. Page covers attached to the edges of the front and rear case bindings to enwrap about and cover the pages and the remaining length of the end segments of the back of the books stored in the case when brought in contact with one another;

d. At least one center flap divider for every pair of books, or fraction thereof, to be stored within the case; said dividers sized at to extend the width and cover the length and edge of the covers of the books to be stored within the case, and longtudinally attached by one edge to the spine and positioned such that said dividers will be sandwiched in between each pair of the books to be stored in the case, said dividers also having their upper and lower edges angled proximate the point of attachment to the spine to enable the divider to clear the page cover flaps drawn in against the case bindings as the case is opened;

e. Vertically alligned pockets attached to and structured to cover both sides of the dividers opposite the point of attachment to the spine, said pockets of a length of the book covers, and of sufficient depth to hold said covers when inserted in the pockets;

f. Closure means associated with the edges of the page covers to selectively secure or open the front and back page covers to one another.

6. An improved multiple book storage and carrying case according to claim 5, including storage pockets attached to the exterior of the case bindings.

7. An improved multiple book storage and carrying case according to claim 5, including a carrying handle attached to the exterior of the spine.

8. An improved multiple book storage and carrying case according to claim 5, wherein the front and back covers are colored and patterned to suit the preference of the user.

9. An improved multiple book storage and carrying case according to claim 5, wherein the closure means is a zipper system associated with the edges of the page cover flaps to selectively open and close the edges of the page covers to one another.

10. An improved multiple book storage and carrying case according to claim 5, wherein the corners of the case covers are rounded.

11. An improved multiple book storage and carrying case according to claim 5, including interior storage pockets attached to the inside case bindings.

12. An improved multiple book storage and carrying case according to claim 5, wherein the interior storage pockets are structured to secure therein small volumes of books by their covers

13. An improved multiple book storage and carrying case according to claim 5, wherein the case and page covers are constructed of a flexible weather resistent material.

14. An improved multiple book storage and carrying case according to claim 5, wherein the handle is constructed of a webbing material sewn to the spine.

15. An improved multiple book storage and carrying case according to claim 5, wherein the handle is constructed of a webbing material of a length at least the width of the hand of a user sewn at both ends about D rings fastened to the exterior of the spine.

16. An improved multiple book storage and carrying case according to claim 5, wherein the handle is constructed of cloth backed vinyl wrapped about an internal reinforcing material and sewn to the exterior of the spine.

* * * * *